United States Patent [19]

Prichard, Jr., deceased et al.

[11] 3,960,355

[45] June 1, 1976

[54] SCAFFOLD SUPPORTING WALER BRACKET

[76] Inventors: Harry A. Prichard, Jr., deceased, King County, Wash.; by Amelia A. Prichard, 29621 - 20th Ave., South, Federal Way, Wash.

[22] Filed: July 11, 1974

[21] Appl. No.: 487,675

[52] U.S. Cl. ..... 249/189; 249/219 W; 269/208

[51] Int. Cl.[2] ..... E04G 17/14

[58] Field of Search ..... 249/219 W, 189; 269/208

[56] References Cited

UNITED STATES PATENTS

| | | | |
|---|---|---|---|
| 3,596,084 | 7/1971 | Henning et al. | 269/208 X |
| 3,730,476 | 5/1973 | Prichard | 249/219 W X |

*Primary Examiner*—Robert D. Baldwin

[57] ABSTRACT

A waler bracket for use in a particular unitized form structure wherein the normally narrow waler is replaced with a scaffold platform and guardrail providing means to releasably maintain scaffolds and guardrail combinations havng varying widths.

3 Claims, 2 Drawing Figures

SCAFFOLD SUPPORTING WALER BRACKET

BACKGROUND OF INVENTION

1. Related Applications

There are no applications related hereto now filed in this or any foreign country.

2. Field of Invention

This invention relates to a waler support bracket for use in a particular modular-type concrete form structure having external metal supporting studs providing joinder means to support such brackets.

3. Description of Prior Art

The instant bracket is an improvement over the waler bracket shown in my earlier patent, Unitized Metal Stud Form Structure, U.S. Pat. No. 3,730,476. The brackets are particularly adapted for usage with the form structure disclosed in that patent. The prior waler bracket provided an elongate fastening element adapted to be releasably carried by a vertical stud and an L-shaped arm extending horizontally outward to support a waler, primarily standard two by four dimension lumber maintained in the bracket by wedging. Subsequent to the prior invention, governmental safety requirements provided for placement of staging or scaffolding of a specified width at the top of any concrete wall form above some minimum height. In addition the staging was required to provide a toeboard and a guardrail to prevent slippage. The instant invention provides a new bracket to secure the required scaffolding with toeboard and guardrail to the form structure while also serving as a waler to thereby eliminate the need of separate staging, external to the forms. To do this, I provide a new waler bracket releasably attached to the form structure in a manner similar to my prior brackets but capably of supporting both the scaffold platform with toeboard and guardrail. My invention provides a simple, economic method whereby scaffolding can be erected on the top of a concrete wall form as a part thereof.

SUMMARY OF INVENTION

My invention provides a reusable scaffold bracket releasably attachable to vertical metal studs of a particular form structure for erecting pour-in-place concrete walls. The bracket has an elongate fastening element having an inwardly projecting fastener adapted to be manipulated into a stud hole and be releasably carried thereby with a U-shaped bracket at the other end to maintain the element on the stud once placed. An elongate brace support bracket extends horizontally outward to carry a combination waler-scaffold and a vertical guardrail post. A screw clamp maintains the waler-scaffold and toeboard thereon and provides a limited amount of adjustability.

In providing such a structure it is:

A principal object of my invention to create an improved, reusable waler support bracket for use with unitized metal stud form structures to support a combination waler-scaffold platform.

A further object of my invention to provide such a bracket that in addition supports vertical guardrail posts at its outer end.

A further object of my invention to provide such a bracket with adjustable clamp means to securely maintain the scaffold and allow some size adjustment.

A still further object of my invention to provide such a support bracket that is of new and novel design, of rugged and durable nature, of simple and economic manufacture and otherwise well adapted for the uses and purposes for which it is intended.

Other and further objects of my invention will appear from the following specification and accompanying drawings which form a part hereof. In carrying out the objects of my invention, however, it is to be understood that its essential features are susceptible of change in design and structural arrangement with only one preferred and practical embodiment being set forth in the accompanying drawings as required.

BRIEF DESCRIPTION OF DRAWINGS

In the accompanying drawings which form a part hereof and wherein like numbers of reference refer to similar parts throughout.

DESCRIPTION OF THE PREFERRED EMBODIMENT

Figure 1:
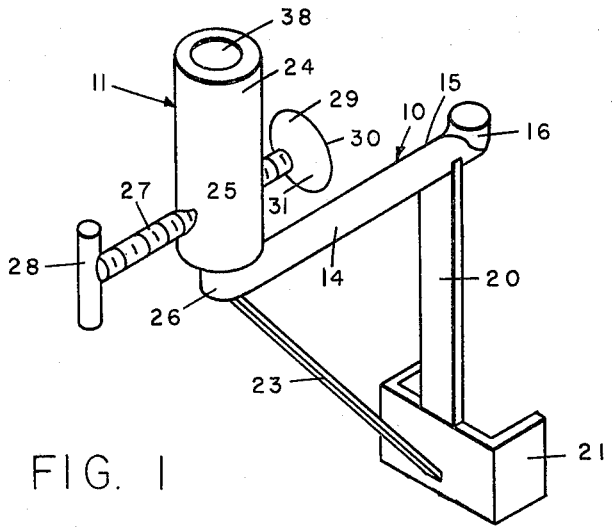
FIG. 1 is an isometric view looking angularly downward at the waler bracket of my invention showing its elements, their configuration and relationship.
Figure 2:
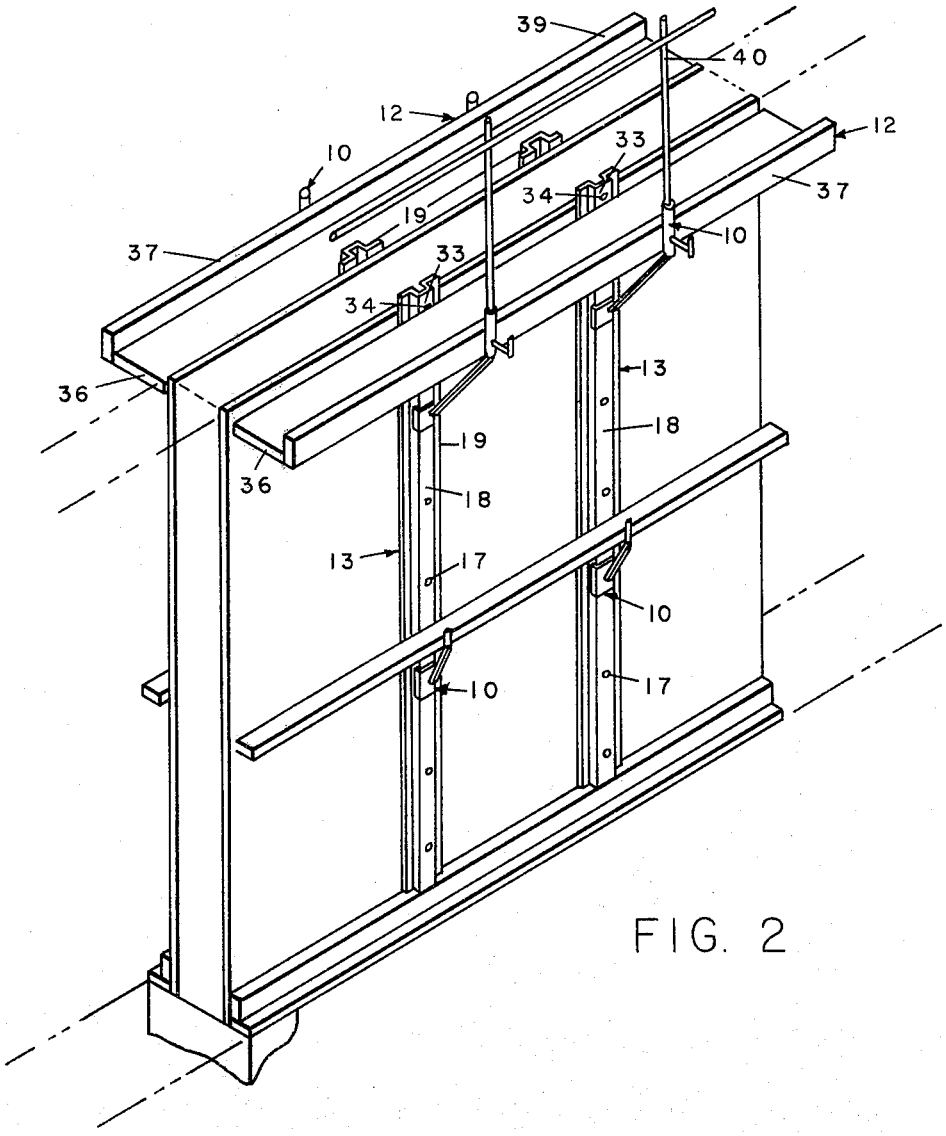
FIG. 2 is an isometric view of a form structure showing placement of my bracket on a unitized metal stud form structure.

Referring now to the drawings in more detail and particularly to that of FIG. 1, it will there be seen that my invention generally comprises bracket member 10 similar to that shown in the prior U.S. Pat. No. 3,730,476, having clamp means 11 to adjustably secure scaffold and toeboard member 12 thereto and rail support element to releasably carry vertical rail supports.

Bracket member 10 provides elongate cylindrical support arm 14 having joined at inner extremity 15 short up-turned fastening arm 16. The support arm and fastening arm is of a cylindrical cross-section and of such size as to fit within holes 17 defined at spaced intervals in forward face 18 of vertical studs 19. The upward extension of the inner fastening arm must be so regulated that the structure may be placed within a stud hole by appropriate manual manipulations but yet allow the inner surface of the projection to catch the inner stud surface above the hole to releasably maintain the bracket on the stud once placed. As noted, this feature is similar to that found on the waler bracket of my prior patent. The length or outward extension of support arm 14 must be sufficient to maintan a standard scaffold platform and toeboard typically comprising two by twelve and two by four dimension lumber respectively. Bracket arm 20 provides an elongate bar which communicates with the under surface of support arm 14 in a position such that outwardly facing surfaces of fastening arm 16 and bracket 20 are spaced apportionately by the thickness of the stud body. Bracket arm 20 depends to structurally communicate with U-shaped bracket 21 configured to fit snugly against stud 19. Angle support 23 communicates from bracket 21 to outer portion 26 of body 14 to provide additional ridigity.

Clamp member 11 provides a cylindrical upright 24 which extends vertically upward from structural joinder with outer horizontal portion 31 of support body 14. Clamp member 11 is of a greater diameter than body 14 and of a length greater than the height of the toeboard which is positioned inwardly adjacent thereto. The clamp member is formed as a hollow cylinder with medial hole 38 which may be conveniently used to join the member on an upturned portion of support body 14 and also to releasably support vertical rail posts for a guardrail. Horizontal inwardly extending hole 25 through upright 24 parallel to body 14 define internal threads to engage externally threaded clamp rod 27. Handle 28 is provided perpendiculr to rod 27 at its outer end to aid manipulation and clamp foot 29 communicates in a pivotably manner with the inner end of rod 27. Clamp foot 29 provides planar inner face 30 and indented arcuate medial portion 31 adapted for ball and socket joinder in rod 27 to aid relative motion of the parts. Hole 25 is positioned slightly below the top surface of the scaffolding, and the threaded rod should have sufficient length to allow the moving of foot 29 to near the mid-point of support 14.

Having thusly described the structure of my invention its use may now be readily understood.

Firstly, a form structure is constructed according to my prior patent, having placed thereon a plurality of studs 19 with the topmost stud hole positioned near the stud's upper extremity 33, immediately below the uppermost snap tie 34. One of the instant supports is then fastened by manual manipulation onto each stud by placing fastening arms 16 into hole 17, then rotating downward and inward until bracket arm 20 and bracket 21 rest against stud forward face 18 with bracket 21 positioned therearound. Scaffold board 36, normally a 2 by 12 plank, is then placed upon plural cooperating support bodies 14 such that its inner edge contacts stud face 18. Toeboard 37, normally a 2 by 4, is placed on end outwardly adjacent thereto. Clamp 11 is then secured by turning handle 28 until scaffold 36 and guardrail 37 are tightly secured between face 18 of the stud and the clamp. A vertical guardrail 39 may then be established upon rail posts 40 releasably positioned in the medial holes of outer uprights 24.

The resulting structure provides a staging atop the form which may be established on either or both sides of the form. This results in a staging that generally satisfies governmental safety requirements relating to scaffolds while simultaneously providing a top waler, without the expense or inconvenience of erecting any exterior supportative framework.

It will be noted from the foregoing that the resulting scaffold, toeboard and guardrail is formed from reusable elements, normally utilized in the construction of this type of form, and readily inter-fitted with the existing elements.

It will further be noted that the clamp adjustability provided by the length of threaded rod 27 allows use of variable width scaffold boards and toeboards or use of a scaffold board only, if this be desired.

The foregoing description of my invention is necessarily of a detailed nature so that a specific embodiment of it might be set forth as required, but it is to be understood that various modifications of detail, rearrangement and multiplication of parts may be resorted to without departing from its spirit, essence, or scope.

Having thusly described my invention, what I desire to protect by Letters Patent, and What I claim is:

1. In a form structure for concrete having a plurality of spaced, aligned vertical prismoidal metal studs, each with holes spaced along its vertical medial centerline, ascaffold supporting waler bracket configured to be releasably supported by a metal stud, comprising, in combination:

an elongate U-shaped support arm having a shorter perpendicularly projecting fastening arm at the inner stud end and a longer perpendicularly projecting cylindrical upright at the outer end with a bracket arm structurally depending from the support arm at a spaced distance from the shorter fastening arm, the bracket arm having a U-shaped bracket in its lowermost portion to fit about the body of a supporting stud when the fastening arm is fastened thereon, and an angle support communicating between the bracket and the outer part of the support arm, the cylindrical upright defining a medial threaded hole aligned parallel with the support arm and threadedly carrying a clamp rod, having handle means at its outer end and engaging means on its inner end to engage scaffold boards carried on the support arm to fasten them against the outer surface of a supporting stud, the cylindrical upright having a vertical medial hole extending above said clamp rod a distance sufficient to releasably receive and support vertical elements adapted to aid in forming a guard rail.

2. The invention of claim 1 further characterized by: the cylindrical upright comprising a hollow cylinder joined to an outer upturned portion of the support arm.

3. The invention of claim 1 further characterized by: the clamp rod engaging means comprising a disk element mounted by a ball and socket joint on the clamp rod.

* * * * *